US007641184B2

(12) United States Patent
Terashima et al.

(10) Patent No.: US 7,641,184 B2
(45) Date of Patent: Jan. 5, 2010

(54) IMAGE READING AND RECORDING APPARATUS

(75) Inventors: Hideyuki Terashima, Kawasaki (JP); Akio Okubo, Tokyo (JP); Yoshiaki Suzuki, Kawasaki (JP); Takashi Awai, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 173 days.

(21) Appl. No.: 11/406,333

(22) Filed: Apr. 19, 2006

(65) Prior Publication Data

US 2006/0244194 A1 Nov. 2, 2006

(30) Foreign Application Priority Data

Apr. 28, 2005 (JP) ..... 2005-131716

(51) Int. Cl.
*B65H 5/00* (2006.01)

(52) U.S. Cl. ..... 271/10.13; 271/126; 271/116; 271/117

(58) Field of Classification Search ..... 271/126, 271/10.11, 10.13, 127, 116, 117
See application file for complete search history.

(56) References Cited

U.S. PATENT DOCUMENTS

| | | | | |
|---|---|---|---|---|
| 4,855,790 | A | 8/1989 | Suzuki | 355/24 |
| 4,998,121 | A | 3/1991 | Koh et al. | 346/160 |
| 5,043,763 | A | 8/1991 | Koh et al. | 355/206 |
| 5,153,655 | A | 10/1992 | Suzuki et al. | 355/285 |
| 5,157,444 | A | 10/1992 | Mori et al. | 355/282 |
| 5,633,704 | A | 5/1997 | Suzuki et al. | 399/69 |
| 5,727,890 | A | 3/1998 | Stodder et al. | 400/624 |
| 6,102,506 | A | 8/2000 | Sasai et al. | 347/3 |
| 6,113,093 | A | 9/2000 | Morinaga et al. | 271/162 |
| 6,257,569 | B1 * | 7/2001 | Rhodes et al. | 271/117 |
| 6,332,608 | B1 * | 12/2001 | Tamura | 271/111 |
| 6,385,406 | B1 | 5/2002 | Funamizu et al. | 399/16 |
| 6,467,767 | B2 * | 10/2002 | Yano | 271/122 |
| 6,536,759 | B1 * | 3/2003 | Takada | 271/125 |
| 6,896,253 | B2 * | 5/2005 | Hanabusa | 271/117 |
| 7,077,157 | B2 * | 7/2006 | Cavagna | 137/491 |
| 7,077,517 | B2 * | 7/2006 | Awai et al. | 347/104 |
| 7,125,013 | B2 * | 10/2006 | Sonoda et al. | 271/121 |
| 7,134,657 | B2 * | 11/2006 | Yanagi et al. | 271/171 |
| 7,165,765 | B2 * | 1/2007 | Sonoda et al. | 271/122 |

* cited by examiner

*Primary Examiner*—Kaitlin S Joerger
(74) *Attorney, Agent, or Firm*—Fitzpatrick, Cella, Harper & Scinto

(57) ABSTRACT

In the image reading and recording apparatus, a separating and feeding unit, a paper end detecting unit, a reading unit, a conveying unit, and a recording unit are arranged in this order from the upstream of the conveying direction. The separating and feeding unit has a switching unit for selectively switching between a separating function of separating the uppermost one of stacked sheets and a feeding function of feeding each separated sheet at a predetermined speed. After a sheet is separated, switching from the separating function to the feeding function is carried out before the paper end detecting unit detects the top end of the sheet.

4 Claims, 6 Drawing Sheets

IMAGE READING AND RECORDING APPARATUS

BACKGROUND OF THE INVENTION

1. Field of the Invention

The present invention relates to an image reading and recording apparatus such as a facsimile machine that includes recording means of performing recording on a sheet as a recording medium and means of reading an image from a sheet.

2. Related background Art

As an image reading and recording apparatus such as a facsimile machine, there has been a structure in which a conveyance path for conveying recording sheets and a conveyance path for conveying documents are partially integrated for the purpose of size and cost reductions. FIG. 6 is a schematic vertical cross-sectional view of a conventional image reading and recording apparatus in which a conveyance path for conveying recording sheets and a conveyance path for conveying documents are partially integrated. In FIG. 6, the image reading and recording apparatus includes an ASF unit (auto sheet feeder) 101, an ADF unit (auto draft feeder) 102, an auxiliary conveying roller (auxiliary conveying means) 103, a main conveying roller (main conveying means) 104, a discharge roller (discharging means) 105, a reading unit (a scanner unit) 106, and a recording unit 107.

The ASF unit 101 is an automatic feeder that supplies recording sheets stacked on a stacking table to the apparatus main body separately from one another. The ADF unit 102 is an automatic feeder that supplies stacked documents to the apparatus main body separately from one another. The auxiliary conveying roller 103 is a roller for conveying the recording sheets or the documents supplied from the ASF unit 101 or the ADF unit 102, and constitutes the auxiliary conveying means with a pinch roller that is in contact with the auxiliary conveying roller 103. The main conveying roller 104 is a roller for conveying each recording sheet or each document at a predetermined speed, and constitutes the main conveying means with a pinch roller that is in contact with the main conveying roller 104. The discharge roller 105 is a roller that discharges the recording sheets or the documents to the outside of the apparatus main body, and constitutes the discharging means with a spur. The reading unit 106 constitutes means of reading image data from documents. The recording means 107 records an image on each recording sheet, based on the image data.

In the above-described structure, the auxiliary conveying roller 103, the main conveying roller 104, and the discharge roller 105 are used for both recording sheets and documents. Also, the guide member that forms a conveyance path is shared, so as to reduce the size and costs of the image reading and recording apparatus. A facsimile machine with such a structure is disclosed in U.S. Pat. No. 5,727,890.

Since the above-described conventional structure has the reading unit 106 on the upstream side of the main conveying roller 104 (on the upstream side in the conveying direction), the auxiliary conveying roller 103 is provided for the purpose of stabilizing the unstable conveying speed (the feeding speed) of the ADF unit 102 and conveying each recording sheet to the main conveying roller 104. In practical use, however, this conventional structure differs from a structure having conveying means and conveyance paths provided respectively for recording sheets and documents, only in that the discharge roller is used for both recording sheets and documents. Therefore, the size and cost reductions of the apparatus main body are not sufficient.

SUMMARY OF THE INVENTION

The present invention has been achieved in order to solve the above problems. It is an object of this invention to provide an image reading and recording apparatus that can perform image reading and image recording with high precision, without the addition of conveying means on the upstream side of the reading means in the conveying direction. Another object of the present invention is to provide an image reading and recording apparatus that has a smaller number of conveying means and integrates the components and functions of the recording sheet conveying system and the document conveying system, so as to reduce size and cost reductions.

To achieve the above objects, an image reading and recording apparatus according to the present invention includes: recording means for performing recording on a sheet; reading means for reading an image from a sheet; separating and feeding means for separating and feeding the uppermost one of stacked sheets, so as to supply sheets to the recording means or the reading means; paper end detecting means for detecting an end of each sent sheet; and conveying means for conveying the sheets. The separating and feeding means, the paper end detecting means, the reading means, the conveying means, and the recording means are arranged in this order from the upstream side of a conveying direction. The separating and feeding means has switching means for selectively switching between a separating function of separating the uppermost one of the stacked sheets and a feeding function of feeding each separated sheet at a predetermined speed. After a sheet is separated, switching from the separating function to the feeding function is carried out before the paper end detecting means detects the top end of the sheet.

According to the present invention, even if the reading means is located between the separating and feeding means and the conveying means, a document can be sent (conveyed) by the feeding function of the separating and feeding means until the top end of the document reaches the conveying means. Also, image reading and image recording can be performed with high precision, without the addition of conveying means on the upstream side of the reading means in the conveying direction. Furthermore, an image reading and recording apparatus that has a smaller and less expensive apparatus main body with a smaller number of conveying means can be provided, with the components and functions being shared between the recording sheet conveying system and the document conveying system.

BRIEF DESCRIPTION OF THE DRAWINGS

FIG. 3A illustrates a situation in which the pressure plate and the separating roller are separated from the feeding roller, and FIG. 3B illustrates a situation in which the pressure plate and the separating roller are in contact with the feeding roller;

FIG. 4A illustrates a situation immediately after the start of a feeding operation, FIG. 4B illustrates a situation in which the return levers are retracted from the feeding path, FIG. 4C illustrates a situation in which the return levers are returned, in the middle of a feeding operation, to the positions in which the return levers were located immediately after the start of the feeding operation, and FIG. 4D illustrates a situation during a feeding stand-by period;

DETAILED DESCRIPTION OF THE PREFERRED EMBODIMENTS

Figure 1:
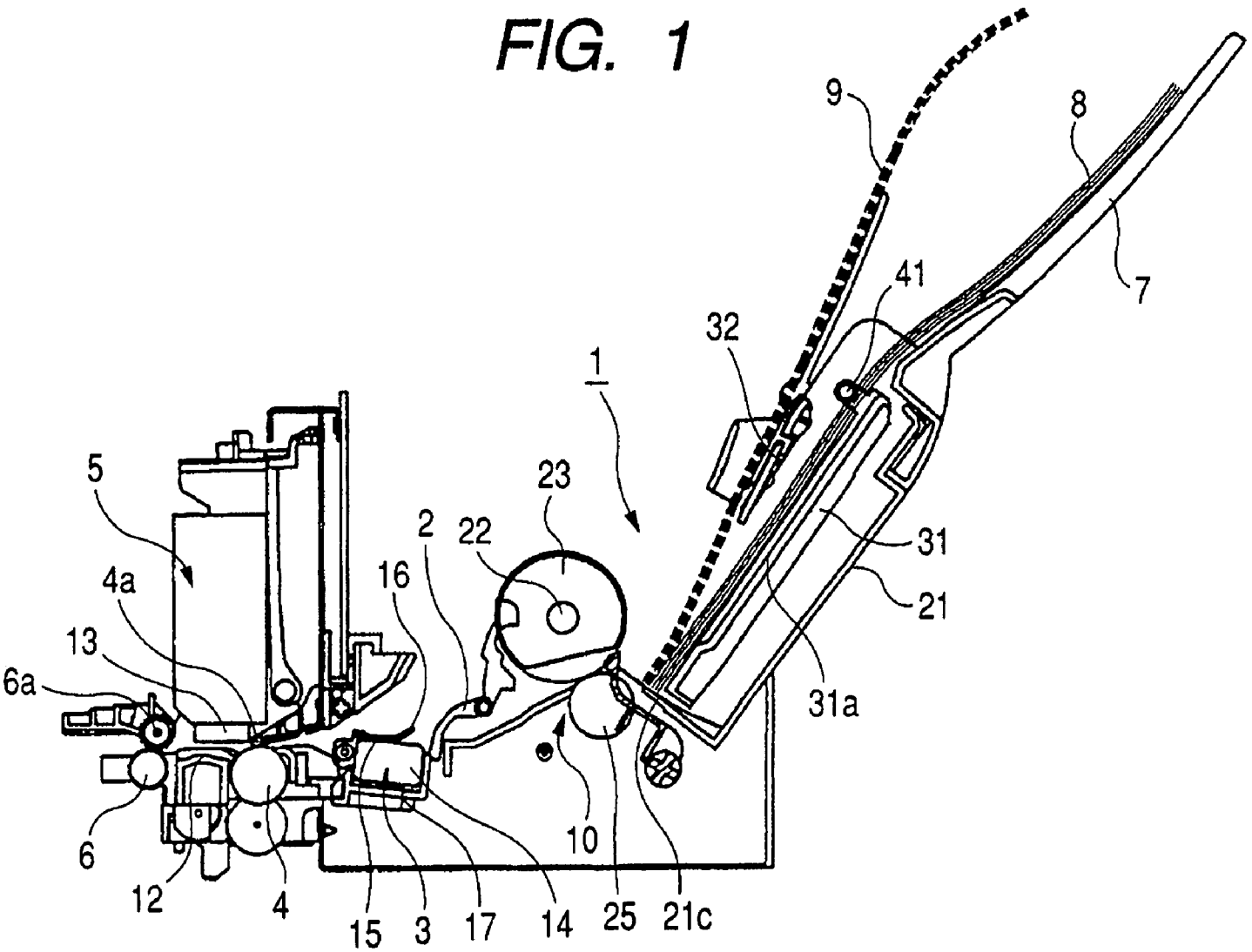
FIG. 1 is a schematic vertical cross-sectional view of the structure of an image reading and recording apparatus according to the present invention.

The following is a detailed description of embodiments of the present invention, with reference to the accompanying drawings. In those drawings, like components are denoted by like reference numerals. FIG. 1 is a schematic vertical cross-sectional view of the structure of an image reading and recording apparatus according to the present invention. In FIG. 1, the image reading and recording apparatus includes an automatic sheet feeder 1, a reading unit 3, and a recording unit 5. The automatic sheet feeder 1 holds stacked recording sheets and documents, and supplies the stacked recording sheets or documents to the apparatus main body separately from one another. The reading unit 3 forms means of reading an image from each document sent from the automatic sheet feeder 1 and conveyed in the apparatus. The recording unit 5 is configured to form an image on each recording sheet sent from the automatic sheet feeder 1 and conveyed in the apparatus, based on image data. In this specification, a "sheet" is either a recording sheet 8 as a recording medium or a document 9 from which an image is to be read.

The automatic sheet feeder 1 has separating and feeding means 10 for separating the top sheet from the stacked recording sheets 8 or documents 9 and supplying the top sheet to the apparatus main body. The separating and feeding means 10 has a feeding roller 23 and a separating roller 25 that are provided at the end (at the feeder outlet) of the automatic sheet feeder 1. A paper end sensor 2 that is paper end detecting means for detecting the top end or the bottom end of a sheet 8 or 9 is provided between the feeding roller 23 and the reading unit 3. A conveying roller 4 for conveying each sheet at a predetermined speed is provided on the upstream side of the recording unit 5 in the conveying direction. A discharge roller 6 for discharging each sheet from the apparatus is provided on the downstream side of the recording unit 5 in the conveying direction. A pinch roller 4*a* that pinches a sheet to generate a conveying force is in contact with the conveying roller 4. The conveying roller 4 and the pinch roller 4*a* constitute conveying means. A spur 6*a* that pinches a sheet to generate a conveying force is also in contact with the discharge roller 6. The discharge roller 6 and the spur 6*a* constitute discharging means.

Next, the recording unit 5 is described. In FIG. 1, a recording sheet 8 separated and supplied by the separating and feeding means 10 is conveyed along the upper face of a platen 12 by the conveying means 4 and 4*a*. During the conveyance, an image is formed on the recording sheet 8 by a recording head 13 as recording means, and the recording sheet 8 is then discharged from the apparatus main body by the discharge means 6 and 6*a*. The recording means (the recording head) of this embodiment is an ink jet recording head that selectively jets ink out of discharge outlets (a discharge outlet row) formed on the discharge face, thereby performing recording based on image data. The recording unit 5 of this ink jet recording type performs recording while jetting ink out of discharge outlets (nozzle outlets) formed at predetermined pitch in the sheet conveying direction on the discharge face of the recording head 13.

The recording unit 5 of this embodiment performs main scanning with the recording head 13 in a direction perpendicular to the conveying direction, thereby performing the recording of one line. When the recording of one line is completed, the recording unit 5 line-feeds (conveys) the recording sheet to the apparatus by predetermined pitch, and performs the recording of the next line. In this manner, the recording unit 5 alternately performs the recording of one line and the line-feeding of the predetermined pitch, thereby performing recording on the entire recording sheet.

In the line-by-line recording operation, if the conveyance accuracy is low with the conveying roller 4 and the pinch roller 4*a*, spaces appear between lines, resulting in white lines, or the lines slightly overlap one another, resulting in black lines. In a color image, the quality of the recorded image might be degraded by color shifting, or the like. Therefore, the conveyance by the conveying means 4 and 4*a* need to be highly accurate. To increase the conveyance accuracy, the driving motor and the conveying roller 4 are connected directly to each other with a small-module gear in this embodiment. Further, a roller that is molded by applying a friction material of several micron meters to a metal core so as to prevent or reduce a decrease in accuracy due to outer diameter tolerance can be used as the conveying roller 4.

The structure of the above-described ink jet recording method is advantageous in terms of size and running cost of the apparatus. However, ink smudges tend to be observed around the recording head 13 due to an ink mist generated at the time of ink discharge, and therefore, attention should be paid to the layout design. In this embodiment, the recording unit 3 is provided on the upstream side of the recording unit 5 in the conveying direction. Accordingly, a recording sheet with ink does not pass through the reading unit 3. Thus, ink smudges are not caused on the reading face (the sensor face) 15 of a contact-image sensor (CS) 14 of the reading unit 3 and on a white member (a white reference) 16 facing the reading face 15, and adverse influence on the read images can be prevented.

Next, the reading means (the reading unit) 3 is described. In FIG. 1, the reading unit 3 serves as a conveyance path for both the recording sheets 8 and the documents 9, and is provided between the separating and feeding means 10 and the conveying means 4 and 4*a*. The reading unit 3 reads an image from each of the documents 9 sent one by one from the separating and feeding means 10 of the automatic sheet feeder 1, and each document 9 is discharged from the apparatus through the conveying roller 4 and the discharge roller 6. The reading unit 3 has the contact-image sensor (CS) 14, a CS holder 17, and the white reference (the white member) 16. The CS holder 17 is configured to have a box-like shape.

The contact-image sensor 14 is housed in the CS holder 17, with the reading face 15 facing outside. The contact-image sensor 14 is secured by a securing member such as a screw. The white reference 16 serves as the reference at the time of reading, and has a white-colored sheet fixed onto a metal board. The sensor face 15 of the contact-image sensor 14 and the white-colored sheet of the white reference 16 face each other, with a space being allowed for at least one document to pass through.

Figure 2:
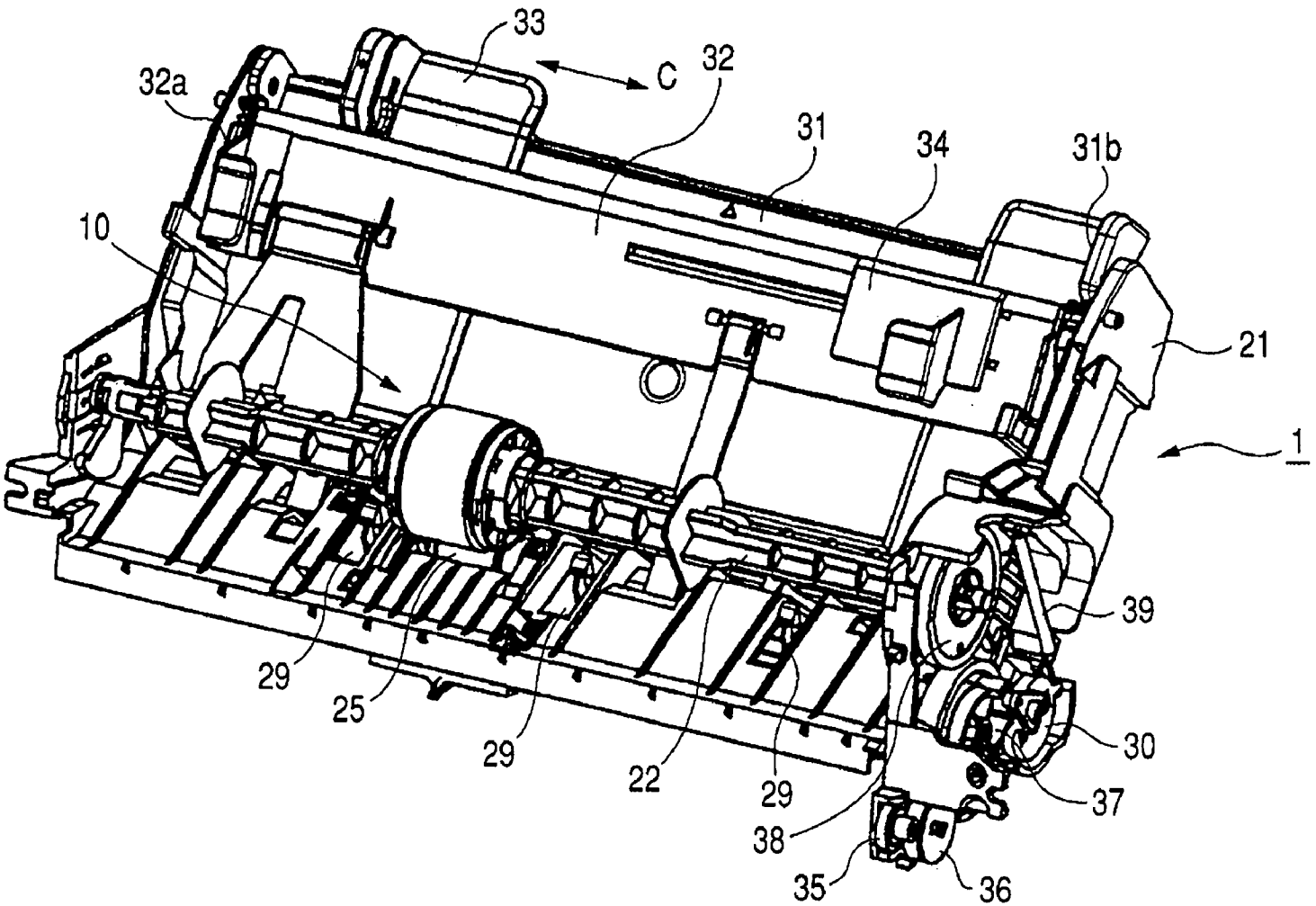
FIG. 2 is a schematic perspective view of the entire structure of the automatic sheet feeder shown in FIG. 1.

FIG. 2 is a schematic perspective view of the entire structure of the automatic sheet feeder 1 shown in FIG. 1. The automatic sheet feeder 1 and the separating and feeding means 10 of the automatic sheet feeder 1 are now described. As shown in FIGS. 1 and 2, a feeding axis 22 integrally formed with the feeding roller 23 is axially supported in a rotatable state by a base member 21 of the automatic sheet feeder 1. The feeding roller 23 is attached to the substantial central portion in the width direction of the sheet of the feeding axis. The feeding roller 23 has a frictional elastic material fixed to the circumferential surface of a cylindrical member having a larger diameter than the feeding axis 22 and a D-cut shape in section. The feeding roller 23 is supported by the base member 21, so as to rotate about the feeding axis 22. A feeding sub-roller 24 for preventing contact of a sheet with the feeding roller 23 when the rotation angle of the feeding roller 23 is within a predetermined range is rotatably attached to a portion of the feeding axis 22 located in the vicinity of the feeding roller 23.

A sheet stacking unit that includes a feeding tray 7 and a document tray 32 is provided in the base member 21 of the automatic sheet feeder 1. A stack of recording sheets 8 is placed on the feeding tray 7 of the base member 21, and a stack of documents 9 is placed on the document tray 32. In the base member 21, a pressure plate 31 for bringing the sheets on the stacking unit into contact with the feeding roller 23 and separating the sheets from the feeding roller 23 is rotatably supported. The document tray 32 on which the documents 9 are stacked is attached to a location above the pressure plate 31 and the recording sheets 8 stacked on the feeding tray 7. As shown in FIG. 1, the document tray 32, together with the pressure plate 31, forms a space to which a predetermined number of recording sheets 8 are to be mounted (inserted).

As shown in FIGS. 1 and 2, the top end of the document tray 32 is located behind the top end of the pressure plate 31, so that the bottom half of each of the documents 9 on the document tray 32 is supported by the document tray 32 while the top half of each of the documents 9 is supported by the pressure plate 31 or the top face of the recording sheets 8. An alignment face 21*c* that restricts the alignment positions of the top ends of the sheets 8 and 9 is provided at the top end of the base member 21. The stacked recording sheets 8 are supported by the pressure plate 31 and the alignment face 21*c*. Meanwhile, the documents 9 on the document tray 32 are supported by the pressure plate 31 and the alignment face 21*c* like the recording sheets 8, when the recording sheets 8 are not stacked. When the recording sheets 8 are stacked, the documents 9 are supported by the top face of the recording sheets 8 and the alignment face 21*c*.

Figure 3B:
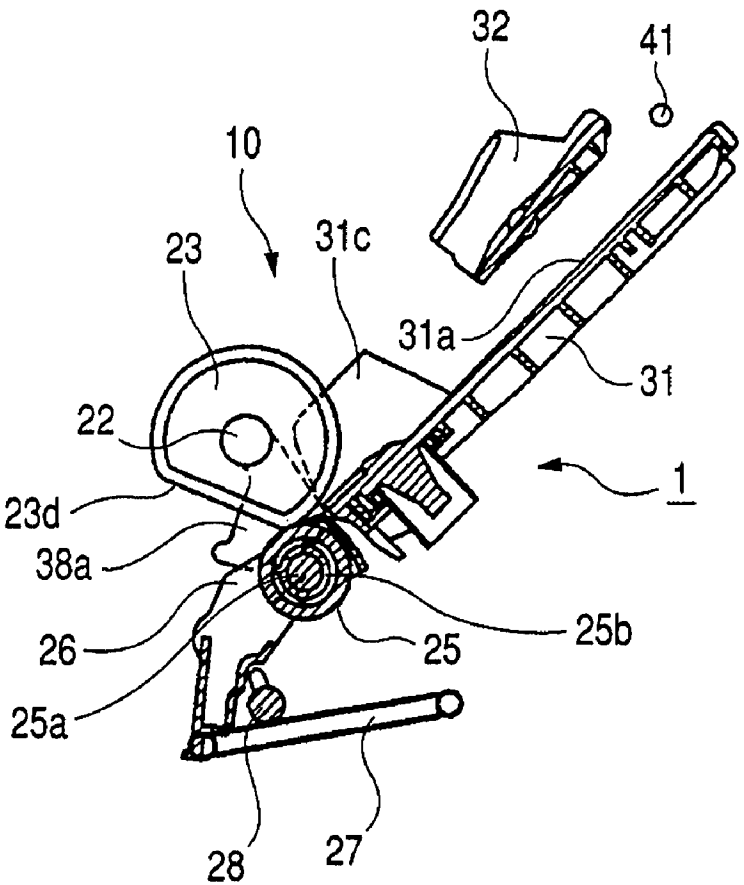
FIGS. 3A and 3B are schematic side views illustrating the structure and operation of the automatic sheet feeder.
Figure 3A:
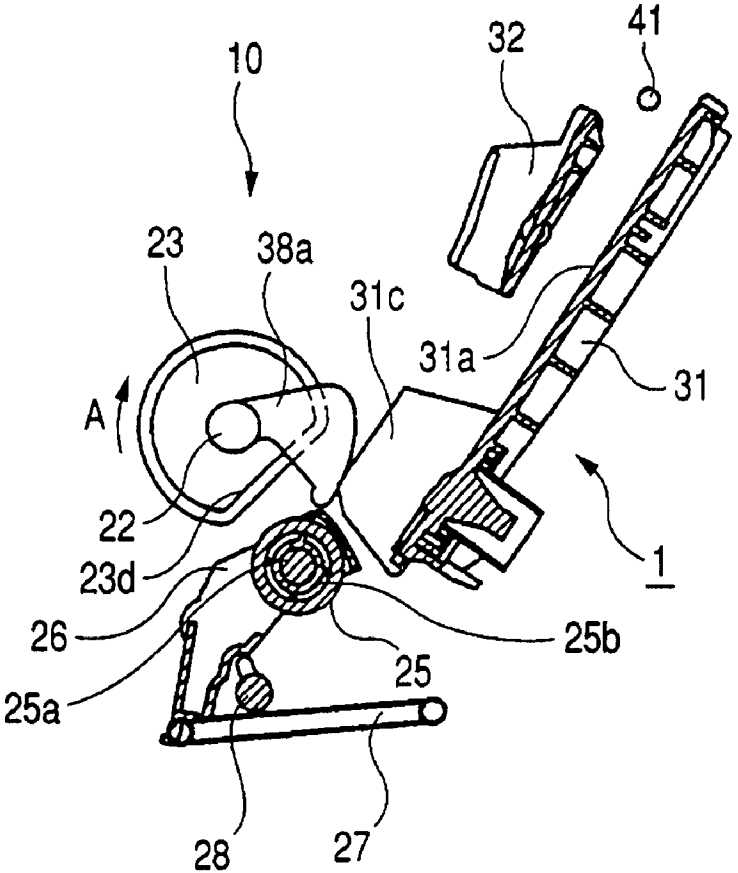

FIGS. 3A and 3B are schematic side views illustrating the structure and the operation of the automatic sheet feeder 1 shown in FIG. 2. FIG. 3A illustrates a situation in which the pressure plate 31 and the separating roller 25 are separated from the feeding roller 23. FIG. 3B illustrates a situation in which the pressure plate 31 and the separating roller 25 are in contact with the feeding roller 23. The separating roller 25 functions as frictional separating means that is involved in the operation of separating sheets from one another as a braking member functioning for all the sheets except for the uppermost one. This separating roller 25 is axially supported by a separating roller axis 25*a* via a torque limiter 25*b*. As shown in FIG. 3, a holder 26 is rotatably attached to the base member 21, and the separating roller axis 25*a* is fixed to or rotatably attached to the holder 26. A spring 27 is provided between the holder 26 and the base member 21. The separating roller 25 is pushed toward the feeding roller 23 by the spring 27. Also, the contact and separation of the separating roller 25 with and from the feeding roller 23 are controlled by a control cam (a cam lever) 28.

Figure 4B:
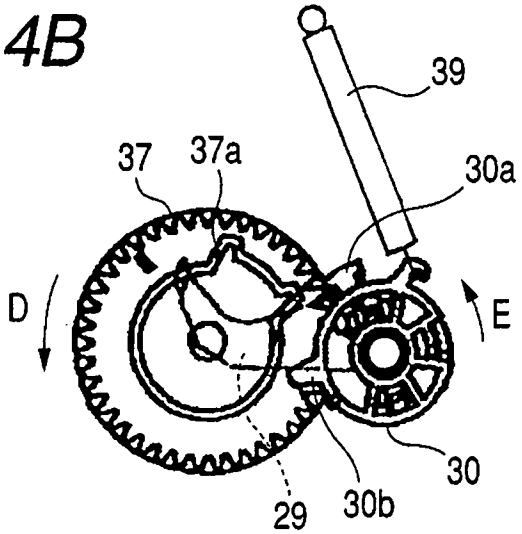
FIGS. 4A, 4B, 4C and 4D are schematic side views illustrating the structures and operations of the overlap preventing means and the driving mechanism of the automatic sheet feeder shown in FIG. 2.
Figure 4D:
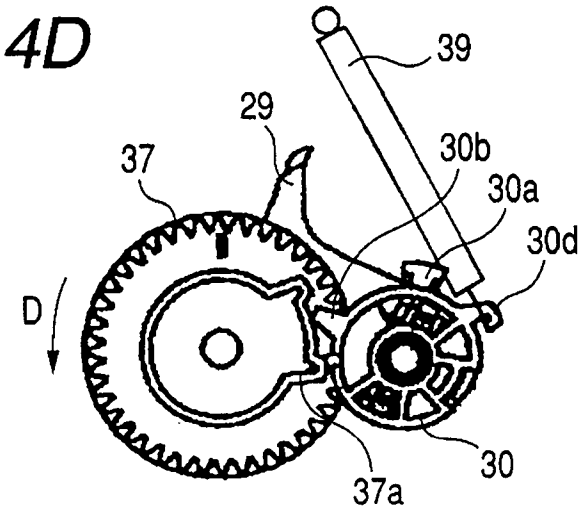
Figure 4A:
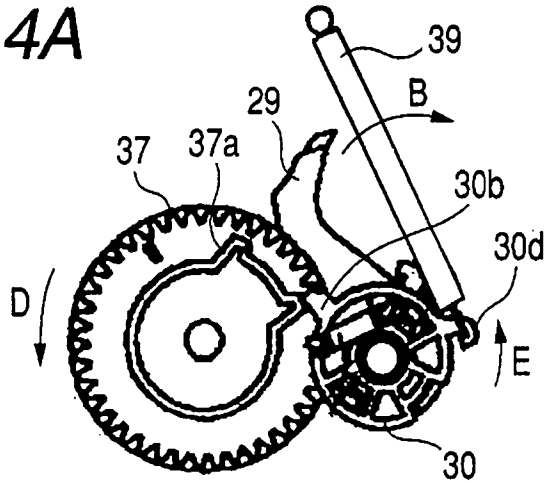
Figure 4C:
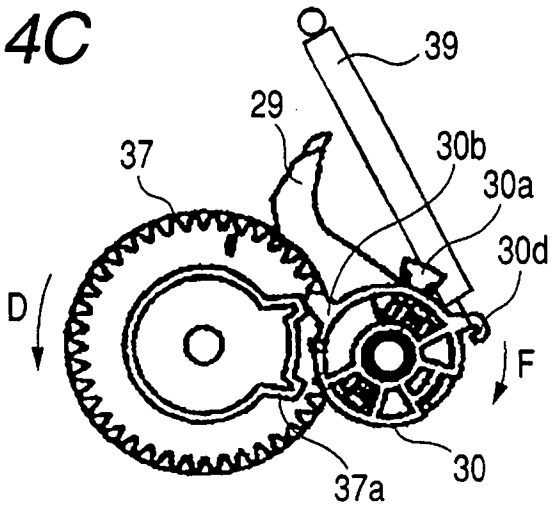

FIGS. 4A, 4B, 4C and 4D are schematic side views of the structure and operation of an overlap preventing means 50 and its driving mechanism. The overlap preventing means 50 prevents simultaneous feeding of two or more sheets supplied from the automatic sheet feeder 1 shown in FIG. 2. FIG. 4A illustrates a situation immediately after the start of a feeding operation. FIG. 4B illustrates a situation in which return levers 29 are retracted from the feeding path. FIG. 4C illustrates a situation in which the return levers 29 are returned, in the middle of the feeding operation, to the positions in which the return levers 29 were located immediately after the start of the feeding operation. FIG. 4D illustrates a situation during the stand-by operation for a feeding operation. As shown in FIGS. 4A, 4B, 4C and 4D, the return levers 29 that are the sheet returning members for preventing feeding of two or more sheets at once is swingably attached to the base member 21. As shown in FIGS. 3A and 3B, the return levers 29 are provided at several locations (three locations) aligned in the sheet width direction.

As shown in FIGS. 4A, 4B, 4C and 4D, each of the return levers 29 is pushed in one direction by a spring. A control cam 30 for driving the return levers 29 is provided at one end of the base member 21 of the automatic sheet feeder 1. The control cam 30 is attached to the member for driving each of the return levers 29, and, together with the member, is rotatably supported. As shown in FIGS. 1, 2, 3A and 3B, the base member 21 has a frame body that tilts while being used. The pressure plate 31 is attached onto the upper face of the frame body. This pressure plate 31 functions as a pressing member that pushes the stacked recording sheets 8 or documents 9 toward the feeding roller 23. Therefore, the pressure plate 31 is pushed toward the feeding roller 23 by a pressure plate spring (not shown) provided between the base member 21 and the pressure plate 31.

As shown in FIGS. 1, 2, 3A and 3B, the document tray 32 on which documents are to be stacked is attached to the base member 21. This document tray 32 is detachably attached to a location at a predetermined distance from a recording sheet stacking face 31*a* of the pressure plate 31. Also, a side guide 33 (shown in FIG. 2) that can slide in the directions of the arrows C perpendicular to the sheet feeding direction is attached to the pressure plate 31. With the side guide 33, the positions of the recording sheets 8 on the pressure plate 31 can be controlled in the directions of the arrows C. A document slider 34 that can slide in the directions of the arrows C is also attached to the document tray 32, so that the positions of the documents on the document tray 32 can be controlled in the directions of the arrows C.

The automatic sheet feeder 1 is formed with the sheet stacking unit, the separating and feeding unit 10, the overlap preventing unit 50, and a driving mechanism unit for controlling the operation of each component. First, the structure and operation of the sheet stacking unit are described. As shown in FIG. 2, the sheet stacking unit of the automatic sheet feeder 1 includes the pressure plate 31, a recording sheet alignment portion 31*b* that protrudes from the pressure plate 31 and serves as the alignment line for side ends of sheets (the recording sheets 8), and the side guide 33 that restricts the other side ends of the recording sheets 8 on the opposite side from the alignment portion 31*b*. In a stand-by state during which the sheet separating and feeding operations are stopped, the pressure plate 31 is located in a predetermined position at a distance from the feeding roller 23. In this situation, a sufficient space for stacking a predetermined number of recording sheets 8 is maintained between the feeding roller 23 and the pressure plate 31. As shown in FIG. 2, the sheet stacking unit also includes the document tray 32, a document alignment portion 32*a* that is provided at the left-side end of the document tray 32 and serves as the alignment line for side ends of the documents 9, and the document slider 34 that restricts the other ends of the documents 9 on the opposite side from the reference portion 32*a*. As shown in FIGS. 1, 2, 3A and 3B, the document tray 32 is shorter than the pressure plate 31, and the top end of the document tray 32 is located behind the top end of the pressure plate 31 in terms of the feeding direction.

As shown in FIG. 1, the recording sheets 8 placed on the stacking face 31*a* is pulled downward by the gravity force, and the bottom ends of the recording sheets 8 are brought into contact with the alignment face 21*c* of the base member 21. This alignment face 21*c* has a rib-like shape so as to reduce the load to be applied onto the recording sheets 8 at the time of the separating and feeding operation. The bottom half in terms of the feeding direction of each of the documents 9 placed on the stacking face of the document tray 32 is supported by the document tray 32, and the top half of each of the documents 9 is supported by the pressure plate 31 and the alignment face 21*c* or the recording sheets 8 on the pressure plate 31 and the alignment face 21*c*.

Next, the structure and operation of the driving mechanism unit for controlling and driving the automatic sheet feeder 1 are described. As shown in FIG. 2 and FIGS. 4A, 4B, 4C and 4D, as the driving mechanism unit for the automatic sheet feeder 1, an input gear 35, a double gear 36, a control gear 37, a feeding axis gear 38, and the control cam 30 are provided on a side face of the base member 21. A cam 37*a* for controlling the operation of the control cam 30 is formed on one face of the control gear 37. The feeding axis gear 38 is fixed to an end of the feeding axis 22 integrally formed with the feeding roller 23.

An end of a push spring 39 is engaged with (linked to) an engaging portion 30*d* of the control cam 30, and the other end of the push spring 39 is engaged with an engaging portion (not shown) of the base member 21. This push spring 39 pushes the control cam 30 in one rotating direction, so that the rotational position of the control cam 30 in relation to the return levers 29 is restricted to a position at a predetermined angle in relation to the rotational position of the cam 37*a* of the control gear 37. Here, the feeding axis gear 38 and the control gear 37 are linked to each other (meshed with each other) at a reduction ratio (a teeth number ratio) of 1 to 1. Accordingly, the gears 37 and 38 synchronously rotate in the same angle phase.

As shown in FIGS. 2, 3A, 3B, 4A, 4B, 4C and 4D, a cam follower 30*b* is formed on the control cam 30 pushed by the push spring 39. This cam follower 30*b* always follows the cam 37*a* of the control gear 37. Therefore, the control cam 30 is rotationally driven in synchronization with the feeding axis 22 via the feeding axis gear 38 synchronously rotating in the same angle phase as the control gear 37. Further, the control cam (the cam lever) 28 shown in FIGS. 3A and 3B is driven by a cam (not shown) provided on the side face on the opposite side of the control gear 37 from the cam 37*a*.

The position (the pressure contact and separation position) of the separating roller 25 in relation to the feeding roller 23 is controlled in synchronization with the rotation of the feeding axis 22, as the control cam 28 rotates. In this manner, a control means for controlling the movement of the separating roller 25 is formed with the cam provided on the opposite side of the control gear 37 from the cam 37*a* and the control cam (the release cam lever) 28 controlling the operation of the holder 26 axially supporting the separating roller 25. The control cam 28 constitutes a part of the driving mechanism of the separating and feeding means 10 shown in FIGS. 3A and 3B.

Next, the structure and operation of the separating and feeding means 10 are described. As shown in FIGS. 3A and 3B, a supporting axis 41 is provided at the upper end of the pressure plate 31, and the pressure plate 31 can rotate (swing) about the supporting axis 41. The movement of the pressure plate 31 is restricted by a spring and a cam. More specifically, the pressure plate spring (not shown) provided between the pressure plate 31 and the base member 21 brings the pressure plate 31 into pressure contact with the feeding roller 23. A cam 31*c* that can be brought into contact with a cam 38*a* provided onto the feeding axis 22 is also attached to the pressure plate 31. The cam 38*a* is provided on a face of the feeding axis gear 38 on the side of the feeding roller 23, and is brought into contact with the cam 31*a* of the pressure plate 31 when the rotational angle of the feeding roller 23 is within a predetermined range.

As the feeding roller 23 rotates in the direction of the arrow A and the cam 38*a* falls off the cam 31*c*, the pressure plate 31 is rotationally moved around the supporting axis 41 toward the feeding roller 23, by virtue of the pushing force of the pressure plate spring. The rotational movement of the pressure plate 31 moving away from the feeding roller 23 is caused by the cam 38*a* of the feeding axis 22 pushing the cam 31*c* in synchronization with the rotation of the feeding roller 23. The operation of bringing the pressure plate 31 into contact with the feeding roller 23 and separating the pressure plate 31 from the feeding roller 23 is performed in predetermined timings that will be described later. In synchronization with the operation, the automatic sheet feeder 1 performs the separating and feeding operation.

Next, the structure and operation of the separating and feeding unit 10 of the automatic sheet feeder 1 are described. As shown in FIGS. 1, 2, 3A and 3B, the pressure plate 31 comes into contact with the feeding roller and moves away from the feeding roller 23 in the predetermined timings, so that the recording sheets 8 or the documents 9 placed on the pressure plate 31 are pressed by the feeding roller 23. At the same time as the pressing, the feeding roller 23 is rotationally driven, so that the uppermost sheet (the sheet in direct contact with the feeding roller 23) among the sheets placed on the pressure plate 31 is sent by virtue of the frictional force generated by the feeding roller 23. In this embodiment, when the documents 9 are stacked on the pressure plate 31, the uppermost document 9 is sent in, and, when the documents 9 are not stacked on the pressure plate 31, the uppermost recording sheet 8 is sent in. In this manner, the feeding roller 23 sends each sheet, using the frictional force. Therefore, the material for the feeding roller 23 is a rubber or urethane foam material with a high frictional coefficient, such as EPDM (ethylene/propylene/diene rubber).

While the cam 38*a* is provided at one end of the feeding axis 22 so as to control the movement of the pressure plate 31, another cam 38*a* is provided at the other end of the feeding axis 22. With both cams 38*a*, both end portions of the pressure plate 31 are held at the same time, so that the pressure plate 31 can be evenly rotated. The uppermost one of the sheets placed on the pressure plate 31 is sent in by the feeding roller 23. At this point, the frictional force between the feeding roller 23 and the uppermost sheet is generally larger than the frictional force between the uppermost sheet and the second uppermost sheet. Accordingly, only the uppermost sheet is sent in most of the time. However, if there is a burr at the end of a sheet, or if sticking between sheets is caused due to static electricity, or if sheets with a high surface frictional coefficient are used, two or more sheets might be pulled out from the pressure plate 31. In such a case, the separating and feeding operation is performed only for the uppermost sheet in the following manner.

On the circumferential face of the feeding roller 23, a sheet (a recording sheet 8 or a document 9) is brought into contact with the separating roller 25 on the downstream side of the first contact point on the feeding roller 23 in terms of the conveying direction. The torque limiter 25*b* formed with a coil (described later) is provided between the separating roller 25 and the separating roller axis 25*a*. The separating roller axis 25*a* is fixed to or rotatably supported (axially supported) by the holder 26 (shown in FIGS. 3A and 3B). The separating roller 25 is supported (axially supported) by the separating roller axis 25*a*.

More specifically, a coil spring that is made of metal or plastic is provided between the separating roller axis 25*a* and the separating roller 25. This coil spring has an inner diameter that is slightly smaller than the diameter (the outer diameter) of the separating roller axis 25*a*. The coil spring has one end fixed to the side of the separating roller 25, so as to be mounted onto the circumferential face of the separating roller axis 25*a*. When predetermined torque is applied to the separating roller 25 while the separating roller axis 25*a* is secured, the coil spring is elastically displaced in the relaxing (loosening) direction. When the value of the predetermined torque exceeds the value of the tightening torque (the torque generated by the spring force tightening the separating roller axis 25*a*) of the coil spring, the tightening force is lost, and the coil spring and the separating roller axis 25*a* slides relatively to each other. The torque limiter 25*b* is configured to maintain the predetermined torque through the above-described mechanism.

Accordingly, when the separating roller axis 25*a* is secured, the separating roller 25 functions to separate one sheet from the rest of the sheets in cooperation with the feeding roller 23, as the torque limiter 25*b* formed with the coil spring is put into an ON state. When the separating roller axis 25*a* is switched to free rotation, the torque limiter 25*b* is put into an OFF state, and the separating roller 25 serves as a following roller that follows the rotation of the feeding roller 23, and sends (conveys) sheets in cooperation with the feeding roller 23. The timing of switching the separating roller 25 between the separating operating operation and the feeding operation by turning ON and OFF the torque limiter 25*b* is controlled by a second cam that is formed on the control cam (the cam lever) 28 controlling the holder 26 shown in FIGS. 3A and 3B. So as to perform the separating function and the feeding function with accuracy, the circumferential face of the separating roller 25 is made of a rubber or urethane foam material with the same frictional coefficient as that of the feeding roller 23.

The switching of the separating roller axis 25*a* between the fixed state and the free rotation state may be carried out by engaging and releasing a stop member with and from the separating roller axis 25*a* or an engaging portion formed integrally with the separating roller axis 25*a*, for example. The engaging and releasing of the stop member can be carried out by the second cam or drive-controllable cam means, or by electromagnetic suction means that can be controlled to be ON and OFF. Alternatively, conventional securing and releasing means may be used to perform drive control. Foe example, the separating roller axis 25*a* may be secured or released with a magnetic suction force.

With the above-described structure having the torque limiter 25*b*, the separating roller 25 rotates, following the rotation of the feeding roller 23, when no sheets exist between the feeding roller 23 and the separating roller 25. When one sheet enters the space between the feeding roller 23 and the separating roller 25, the sheet is separated and sent by the separating roller 25 following the rotation of the feeding roller 23, as the frictional force between the feeding roller 23 and the sheet is larger than the frictional force between the sheet and the separating roller 25 rotating with the predetermined torque.

When two sheets enter the space between the feeding roller 23 and the separating roller 25, the frictional force between the feeding roller 23 and the sheet on the feeding roller 23 is larger than the frictional force between the two sheets, and the frictional force between the separating roller 25 and the sheet on the side of the separating roller 25 is also larger than the frictional force between the two sheets. Accordingly, the two sheets slip off each other. As a result, only the sheet on the feeding roller 23 is separated and sent in. The sheet on the separating roller 25 remains in place and is not sent in, as the separating roller 25 stops rotating. In this manner, the separating roller 25 functions to separate overlapping sheets from one another.

Next, the structure and operation of the overlap preventing means (unit) 50 of the automatic sheet feeder 1 are described. When two or a few sheets enter the space (a nip portion) between the feeding roller 23 and the separating roller 25, only one sheet can be separated and sent in, as described above. However, when a larger number of sheets enter the nip portion, or when two sheets enter the nip portion and only the sheet on the side of the feeding roller 23 is sent in and the next sheet follows while the other sheet remains near the nip portion, two or more sheets might be sent in at once. So as to prevent the overlap feeding, the overlap preventing means 50 is provided in the automatic sheet feeder 1. Driving of the overlap preventing unit 50 is controlled by the control cam 30 and the return levers 29 of the driving mechanism unit shown in FIGS. 2, 4A, 4B, 4C and 4D.

The overlap preventing unit 50 prevents feeding of overlapping sheets. In the driving mechanism unit shown in FIGS. 2, 4A, 4B, 4C and 4D, the return levers 29 operate in synchronization with the rotation of the control gear 37. Roughly speaking, the return levers 29 take the four positions shown in FIGS. 4A, 4B, 4C and 4D, respectively. FIG. 4A illustrates a situation immediately after the start of a feeding operation. FIG. 4B illustrates a situation in which the return levers 29 are retracted from the feeding path. FIG. 4C illustrates a situation in which the return levers 29 are returned, in the middle of the feeding operation, to the positions in which the return levers 29 were located immediately after the start of the feeding operation. FIG. 4D illustrates a situation during the stand-by operation for a feeding operation.

In the situation immediately after the start of a feeding operation illustrated in FIG. 4A, new recording sheets or documents might be stacked, and the top ends of those sheets might be unaligned during the feeding stand-by period. Therefore, the top ends of the stacked sheets are returned to the predetermined positions on the alignment face 21*c* of the stacking unit. The positions of the return levers 29 shown in FIG. 4A are the furthest positions in the direction of the arrow B from the original positions of the return levers 29. When the return levers 29 come to these positions, the top end of the precedent sheet (8 or 9) is pushed back to the alignment face 21*c*. The control gear 37 then rotates in the direction of the arrow D, and the cam follower 30*b* of the control cam 30 is disengaged from the cam 37*a* of the control gear 37. The return levers 29 then rotate in the direction of the arrow E by virtue of the pushing force of the push spring 39.

FIG. 4B illustrates a situation in which the return levers 29 rotationally move to the furthest positions in the direction of the arrow E. In this situation, the return levers 29 are retracted from the sheet feeding path. Here, a protrusion 30*a* protruding from the control cam 30 is brought into contact with a flange portion (not shown) provided on the opposite face of the control gear 37 from the cam 37*a*, so that the control cam 30 stops and the return levers 29 are located in the predetermined retracting positions. As the control gear 37 further rotates in the direction of the arrow D in the situation illustrated in FIG. 4B, the return levers 29 are returned, in the middle of the feeding operation, to the positions in which the return levers 29 were located immediately after the start of the feeding operation, as shown in FIG. 4C. In this situation, the positions of the return levers 29 are substantially the same as the positions shown in FIG. 4A.

During a feeding stand-by period, the automatic sheet feeder 1 is in the situation illustrated in FIG. 4D. In the positions at the time of standing by, the top ends of the return levers 29 enter the sheet feeding path. Since the top ends of the return levers 29 enter the sheet feeding path, the top ends of recording sheets 8 or documents 9 can be prevented from inadvertently enter deep inside the automatic sheet feeder 1 when the recording sheets 8 or the documents 9 are set in the stacking unit of the automatic sheet feeder 1.

As shown in FIGS. 3A and 3B, a flat D-cut face 23*d* that extends in parallel with the rotational axis (the feeding axis 22) of the feeding roller 23 is formed on the circumferential face of the feeding roller 23, so that the feeding roller 23 has a D-like shape in section. As the D-cut face 23*d* faces the separating roller 25, a space is formed between the feeding roller 23 and the separating roller 25. After the top end of a sheet separated and sent in by one rotation of the feeding roller 23 is pinched between the conveying roller 4 and the pinch roller 4*a* of the conveying means, the bottom half of the sheet being conveyed passes through the space formed between the feeding roller 23 and the separating roller 25.

In the structure illustrated in FIGS. 1, 2, 3A and 3B, the entire sheet moving path (the feeding path and the conveyance path) is bent in a dogleg-like shape, a sheet tends to wind around the feeding roller 23, if the sheet has low stiffness. Therefore, if no measures are taken, a large frictional load is applied to a sheet when the sheet comes into contact with the feeding roller 23 exhibiting a large frictional coefficient on its circumferential face. To counter this problem, a sub-feeding roller that exhibits a low frictional coefficient with each sheet and readily moves with each sheet is provided at a portion of the feeding axis 22 in the vicinity of the feeding roller 23.

Figure 5:
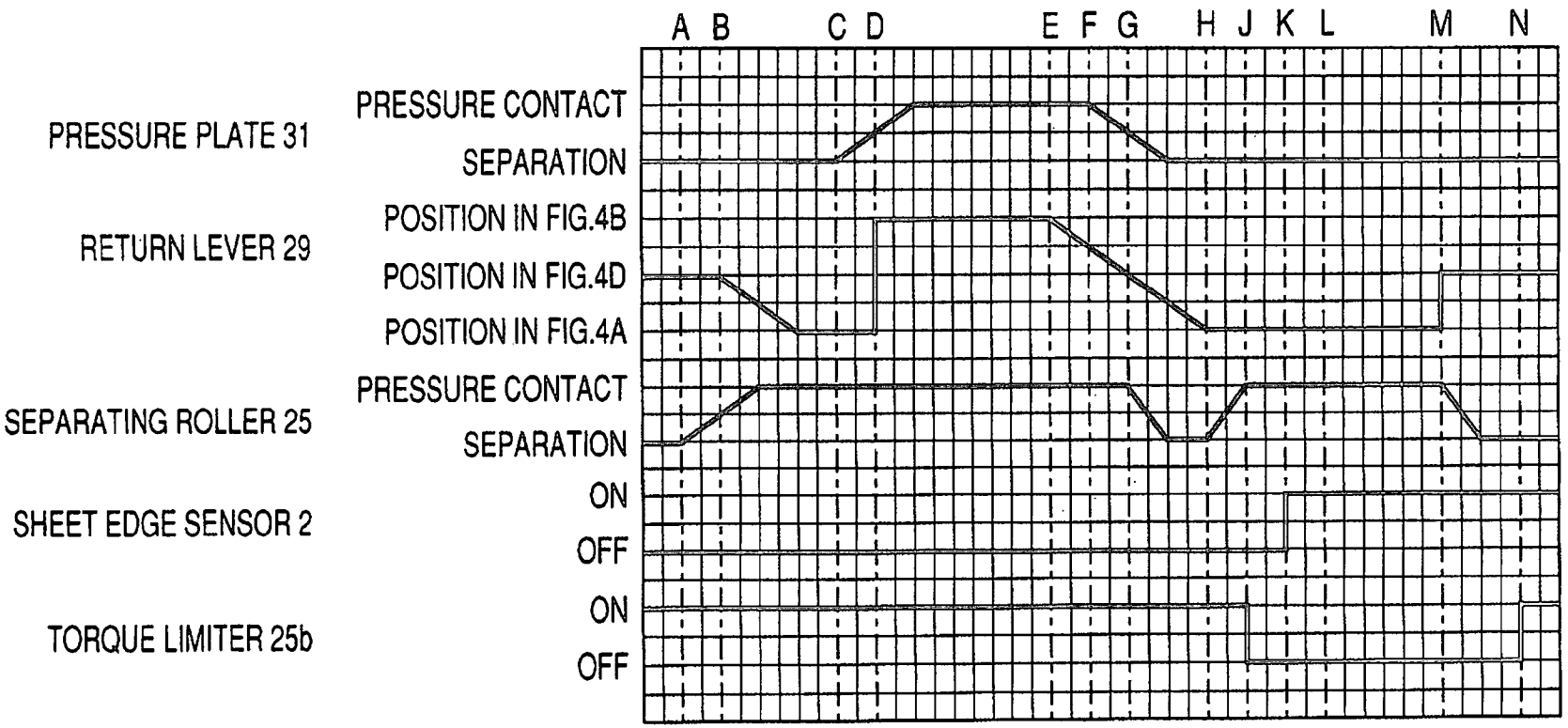
FIG. 5 is a timing chart illustrating the operations of the principal components controlling the operation of the automatic sheet feeder in an image reading and recording apparatus to which the present invention is applied.
Figure 6:
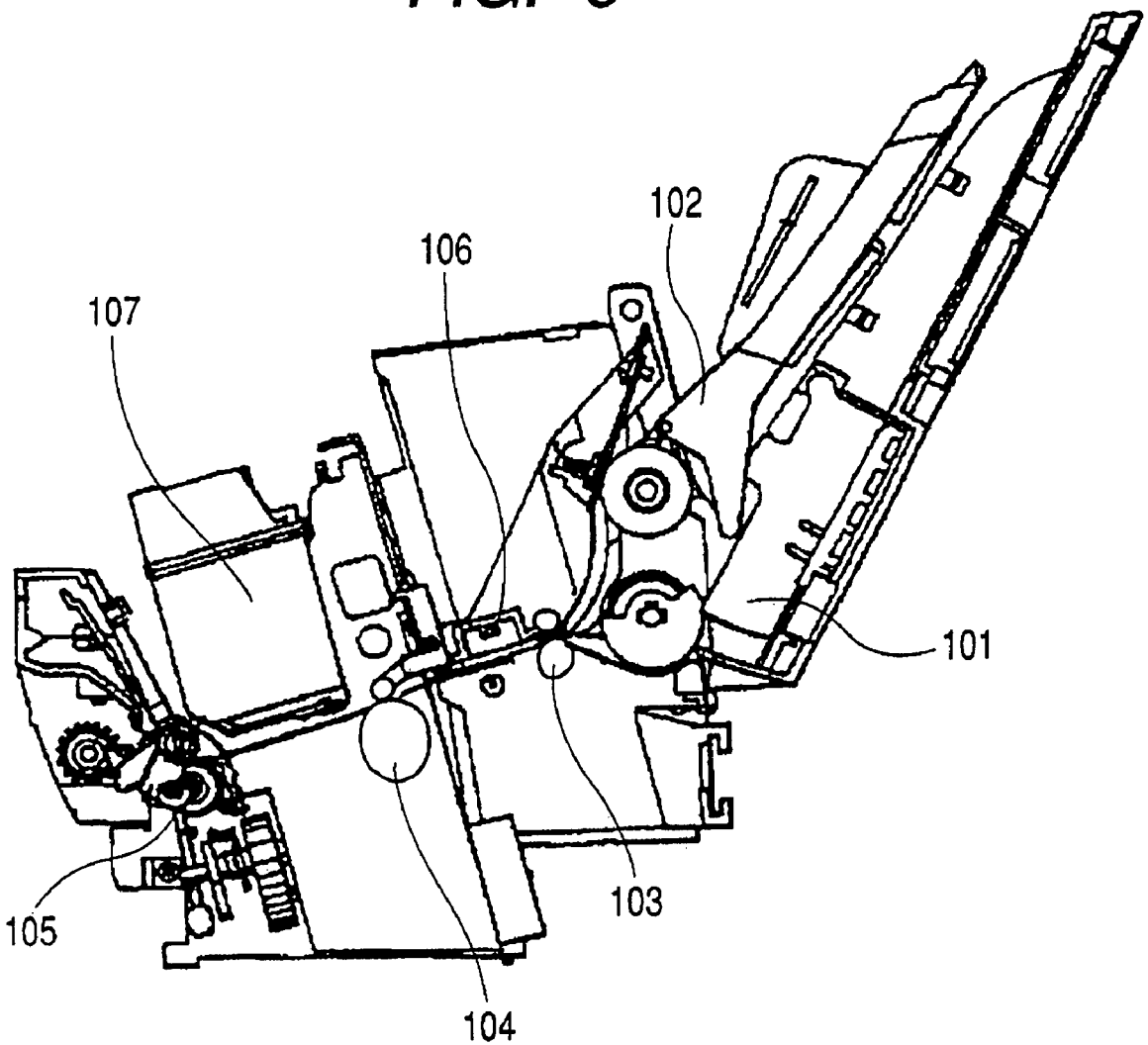
FIG. 6 is a schematic vertical cross-sectional view of a conventional image reading and recording apparatus in which the conveyance path for recording sheets and the conveyance path for documents are partially integrated.

FIG. 5 is a timing chart illustrating the operations of the principal components controlling the operation of the automatic sheet feeder in an image reading and recording apparatus to which the present invention is applied. Referring to the timing chart of FIG. 5, the operation of the automatic sheet feeder 1 of the above-described image reading and recording apparatus is described. FIG. 5 shows the position of the pressure plate 31, the positions of the return levers 29, the position of the separating roller 25, the ON/OFF state of the paper edge sensor (the paper end detecting means) 2, and the ON/OFF state of the torque limiter 25*b* of the separating roller 25.

In FIG. 5, the left-side end of the timing chart shows the stand-by state in which the pressure plate 31 and the separating roller 25 are separated from the feeding roller 23 as shown in FIG. 3A. A series of operations starts from this stand-by state. In the stand-by state, the pressure plate 31 is held in a position at a distance from the feeding roller 23, and the return levers 29 are in the feeding stand-by positions shown in FIG. 4D. The separating roller 25 is held in a position at a distance from the feeding roller 23, and the D-cut face 23*d* of the feeding roller 23 faces the separating roller 25. The paper end detecting means (the paper edge sensor) 2 is in an OFF state, and the torque limiter 25*b* of the separating roller 25 is in an ON state.

As the feeding roller 23 rotationally moves to "angle A", the control cam 28 starts operating, and the separating roller 25 starts moving from the retracted position to the pressure contact position. The feeding roller 23 then rotationally moves to "angle B", and the control cam 30 causes the return levers 29 to start moving to the positions shown in FIG. 4A. The top ends of sheets that are set in the stacking unit and might be unaligned while the return levers 29 are in the stand-by positions are aligned with the alignment face 21*c* at the top end portion of the base member 21. While the feeding roller 23 is rotationally moving from "angle B" to "angle C", the arc-like circumferential face of the feeding roller 23 rotationally moves to such a position as to face the separating roller 25. At the same time, the separating roller 25 that has been moving toward the feeding roller 23 finishes moving, and the separating roller 25 is brought into pressure contact with the arc-like circumferential face of the feeding roller 23. When the feeding roller 23 then rotationally approaches "angle C", the fixation of the pressure plate 31 by the cam 38*a* is canceled, and the pressure plate 31 and recording sheets 8 or documents 9 set on the pressure plate 31 start moving toward the feeding roller 23.

When the feeding roller 23 rotationally moves to "angle D", the return levers 29 move from the positions shown in FIG. 4A directly to the retracted positions shown in FIG. 4D, and are thus retracted from the sheet moving path. As the return levers 29 are retracted, the uppermost sheet of the set of sheets placed on the pressure plate 31 is brought into pressure contact with the feeding roller 23. As the uppermost sheet is in pressure contact with the feeding roller 23, several sheets from the top are sent into the nip portion between the feeding roller 23 and the separating roller 25. Only the uppermost sheet is separated from the others at the nip portion, and the separated sheet is sent to the downstream side. Here, as the separating roller axis 25*a* is fixed, the torque limiter 25*b* is in an ON state. Due to the action of the torque limiter 25*b* of the separating roller 25, a reaction force acting in the opposite direction from the feeding direction is applied to the sheet in pressure contact with the feeding roller 23. Therefore, the sheet in pressure contact with the feeding roller 23 is separated and sent in, while slipping off the feeding roller 23.

When the feeding roller 23 rotationally approaches "angle E", the return levers 29 start rotating in the direction of the arrow F shown in FIG. 4C. When the feeding roller 23 rotationally approaches "angle F", the cam 38*a* provided on the feeding axis 22 starts separating the pressure plate 31 from the feeding roller 23. As the pressure plate 31 moves away from the feeding roller 23, the pressure contact between the sheet on the pressure plate 31 and the feeding roller 23 is released, and the sheet feeding decreases accordingly. However, since the separating roller 25 and the feeding roller 23 are still in pressure contact with each other, the sheet feeding continues.

When the feeding roller 23 approaches "angle G", the control cam 28 causes the separating roller 25 to start moving away from the feeding roller 23. As the separating roller 25 moves away from the feeding roller 23, the contact pressure force of the sheet against the feeding roller 23 is lost, and so is the force of holding sheets in the automatic sheet feeder 1. In the timing of losing the sheet holding force, the return levers 29 start entering the sheet moving path. As the return levers 29 enter the sheet moving path, the top end of the next sheet is scratched back to the sheet stacking unit by the top ends of the return levers 29, if the top end of the next sheet remains in the vicinity of the nip portion between the feeding roller 23 and the separating roller 25.

When the feeding roller 23 rotationally moves to "angle H", the return levers 29 are moved back to the positions shown in FIG. 4C, which are almost the same as the positions shown in FIG. 4A. Except for the separated sheet that is being conveyed, the top ends of the sheets are moved back (returned) to the alignment face 21*c* at the top end portion of the base member 21. The separating roller 25 that has been separated from the feeding roller 23 starts moving again toward the feeding roller 23. The pressure plate 31 is pushed back to the separated position of FIG. 3A by the cam 38*a* provided on the feeding axis 22, while the feeding roller 23 is located between "angle G" and "angle H".

When the feeding roller 23 rotationally moves to "angle J", the separating roller 25 is again brought into pressure contact with the feeding roller 23, and the separating roller axis 25*a* is switched from the fixed state to the free rotation state. Accordingly, the torque limiter 25*b* is switched from an ON state to an OFF state. The separating roller 25 is then switched from the separating function to the feeding function (the conveying function), and resumes sheet feeding in cooperation with the feeding roller 23. In this situation, the separating roller 25 serves as a rotatable counter roller. Unlike in the operations up to "angle J" where the torque limiter 25*b* is in an ON state, each sheet is stably sent at a predetermined speed, without slipping off the feeding roller 23. Even if the reading means 3 is disposed between the separating and feeding means 10 and the conveying means 4 and 4*a*, a document 9 can be sent (conveyed) with high precision by the feeding function of the separating and feeding means 10, until the top end of the document 9 reaches the conveying means 4 and 4*a*.

When the feeding roller 23 rotationally moves to "angle K", the paper edge sensor 2 is switched ON, and the sheet is sent (conveyed) to the reading means (the reading unit) 3. When the feeding roller 23 rotationally approaches "angle L", the location of the top end of the sheet is determined, and the reading unit 3 starts reading the image of the sheet, if the sheet is a document 9. When the feeding roller 23 rotationally moves to a spot immediately before "angle M", the top end of the sheet is nipped by the nip portion of the conveying means formed with the conveying roller 4 and the pinch roller 4*a*. At almost the same time as this (when the feeding roller 23 rotationally moves to "angle M"), the control cam 28 causes the separating roller 25 to start moving away from the feeding roller 23. At the same time as this, the control cam 30 is returned to the angle position of the stand-by period shown in FIG. 4D, and accordingly, the return levers 29 are returned to the stand-by positions shown in FIG. 4D.

When the feeding roller 23 rotationally moves to "angle N", the separating roller axis 25*a* is fixed, and the torque limiter 25*b* is switched to an ON state. Accordingly, the separating roller 25 is switched from the feeding function to the separating function, and becomes ready again for separating and feeding a sheet in cooperation with the feeding roller 23. While the feeding roller 23 is located between "angle M" and "angle N", the separating roller 25 is returned to the separated position shown in FIG. 3A. Here, the control sequence for controlling the operation of the automatic sheet feeder 1 in synchronization with one rotation of the feeding roller 23 comes to an end. If the sheet separated and sent in the above control sequence is a document 9, the reading means 3 reads the image of the document 9, while the conveying means 4 and 4*a* are conveying the document 9. The read document 9 is then discharged from the apparatus main body by the discharging means 6 and 6*a*.

The control sequence described in conjunction with FIG. 5 is the same for any recording sheet 8 and any document 9. More specifically, the control sequence described in conjunction with the timing chart of FIG. 5 is also executed in a driving and controlling operation in which a recording sheet 8 is separated and sent from the automatic sheet feeder 1 and the recording head 13 of the recording unit 5 is set ready for performing recording on the recording sheet 8 being conveyed by the conveying means formed with the conveying roller 4 and the pinch roller 4*a*. The recording sheet 8 is separated and sent by rotating the feeding roller 23 once, and conveyance of the recording sheet 8 is started after the position of the top end of the recording sheet 8 is determined by the conveying means 4 and 4*a*. Thus, recording on the recording sheet 8 is started. The recording sheet 8 on which recording has been performed is discharged to the outside through the discharging means formed with the discharge roller 6 and the spur 6*a*.

The feeding accuracy of the conveying function of the conveying means 4 and 4*a* is higher than the feeding accuracy of the feeding function of the feeding roller 23 and the separating roller 25, which is higher than the feeding accuracy of the separating function of the feeding roller 23 and the separating roller 25. The conveyance accuracy of the conveying means 4 and 4*a* is several micron meters. The feeding accuracy of the feeding function of the feeding roller 23 is several tens to 100 μm. The feeding accuracy of the separating function of the feeding roller 23 varies in the range of several millimeters depending on the frictional coefficient of the sheet surface, because the torque limiter 25*b* serves as a brake.

Therefore, if a high conveyance accuracy is required in recording, the recording sheets are conveyed only by the conveying means 4 and 4*a*. If a variation of several tens μm does not affect the read image of a document, the top end is conveyed through the reading unit 3 by the feeding function of the separating and feeding means 23 and 25, and, after the top end of the document is nipped by the conveying means 4 and 4*a*, the document is conveyed by the conveying means 4 and 4*a*. In this manner, either documents or recording sheets can be conveyed with sufficiently high precision by the three roller pairs of the separating and feeding means 23 and 25, the conveying means 4 and 4*a*, and the discharging means 6 and 6*a*, without the addition of an auxiliary roller for conveying documents. Thus, size and cost reductions can be realized in an image reading and recording apparatus.

When a document 9 is to be read, the separating roller 25 is switched from the separating function to the conveying function before the paper edge sensor 2 on the upstream side of the reading unit 3 detects the top end of the document 9. Accordingly, the separating roller 25 can be certainly switched to the conveying function before the document 9 is read. In this embodiment, the second cam provided on the control cam (the cam lever) 28 controlling the holder 26 controls the timing of switching the separating roller 25 from the separating function to the feeding function.

In the above-described embodiment, even if the document means is located between the separating and feeding means and the conveying means, a document can be sent (conveyed) by the feeding function of the separating and feeding means until the top end of the document reaches the conveying means. Also, image reading and image recording can be performed with high precision, without the addition of conveying means on the upstream side of the reading means in the conveying direction. Furthermore, an image reading and recording apparatus that has a smaller and less expensive apparatus main body with a smaller number of conveying means can be provided, with the components and functions being shared between the recording sheet conveying system and the document conveying system.

In the above-described embodiment, a serial-type structure in which the recording unit performs recording with a recording head mounted on a carriage is described. However, the present invention can be applied to other types of image reading and recording apparatuses such as an image reading and recording apparatus equipped with a line-type recording means formed with a full-line head, and the same effects as the effects of the above-described embodiment can be achieved. Also, in the above-described embodiment, the recording unit is of an ink jet type. However, the present invention can be applied to any recording methods, such as the thermal transfer method, the heat sensitive recording method, the laser beam method, and the wire dot-matrix method. With any recording method, the same effects as those of the above-described embodiment can be achieved.

The present invention can also provide the same effects as those of the above-described embodiment, regardless of the type of the structure and the number of recording means (recording heads). An image reading and recording apparatus according to the present invention can be used not only as it is, but also as the image reading and recording apparatus in a complex apparatus combining a copying machine, a facsimile machine, an image forming apparatus, and the likes, or as the input/output device in a complex apparatus such as a computer system. In this manner, an image reading and recording apparatus according to the present invention can be widely used for apparatuses that perform reading and recording of image information, to achieve the same effects as those of the above-described embodiment.

This application claims priority from Japanese Patent Application No. 2005-131716 filed on Apr. 28, 2005, which is hereby incorporated by reference herein.

What is claimed is:

1. An image reading and recording apparatus comprising:

recording means for performing recording on a sheet;

reading means for reading an image from a sheet;

separating and feeding means for separating and feeding an uppermost one of stacked sheets, so as to supply sheets to the recording means and the reading mean; and conveying means for conveying the sheets, wherein the separating and feeding means, the reading means, the conveying means, and the recording means are arranged in this order from an upstream side of a conveying direction, wherein the separating and feeding means comprises a feeding roller, a separating roller that can be brought into contact with the feeding roller, and a torque limiter, wherein when the uppermost sheet is fed by said feeding roller from the stacked sheets, said torque limiter is effective so that said separating roller separates the fed sheet from other sheets, and wherein when the sheet is a document, said reading means reads an image on the sheet fed by said feeding roller, when said reading means starts to read the image on the sheet, said torque limiter is ineffective and the sheet is conveyed by said feeding roller in cooperation with said separating roller and the sheet is not conveyed by the conveying means, and after said reading means starts to read the image on the sheet, the leading end of the sheet reaches the conveying means fed by said feeding roller when the sheet is a document.

2. The image reading and recording apparatus according to claim 1, wherein the separating roller is axially supported by a separating roller axis that can be selectively switched between a fixed state and a free rotation state, and the torque limiter is provided between the separating roller axis and the separating roller.

3. The image reading and recording apparatus according to claim 2, wherein the torque limiter has an inner diameter slightly smaller than the diameter of the separating roller axis, and has one end being formed with a coil spring fixed to the separating roller, the torque limiter maintaining predetermined torque as predetermined torque is applied to the separating roller to loosen the coil spring when the separating roller axis is fixed.

4. The image reading and recording apparatus according to claim 1, wherein the conveying means has a conveyance accuracy that ensures high quality in a recorded image, and the feeding function of the separating and feeding means has a feeding accuracy that is lower than the conveyance accuracy of the conveying means and ensures a reading function in the reading means.

* * * * *